United States Patent [19]

Moon

[11] 4,406,077

[45] Sep. 27, 1983

[54] CHANGEABLE EXHIBITOR

[75] Inventor: John E. Moon, Greenville, S.C.

[73] Assignee: Gem Signs, Inc., Greenville, S.C.

[21] Appl. No.: 388,116

[22] Filed: Jun. 14, 1982

[51] Int. Cl.[3] ..... G09F 11/30

[52] U.S. Cl. ..... 40/509; 40/369

[58] Field of Search ..... 40/368, 369, 447, 452, 40/491, 375, 462, 488, 491, 509

[56] References Cited

U.S. PATENT DOCUMENTS

| | | | |
|---|---|---|---|
| 563,772 | 7/1896 | Jacson | 40/491 |
| 876,278 | 1/1908 | Mayerle | 40/491 |
| 946,649 | 1/1910 | Woernle | 40/368 |
| 1,067,249 | 7/1913 | Hutchinson | 40/369 |
| 2,025,242 | 12/1935 | Hutchinson | 40/369 |
| 3,250,031 | 5/1966 | Bowman | 40/447 |
| 3,384,888 | 5/1968 | Harnden et al. | 40/452 |
| 3,458,944 | 8/1969 | Jimenez | 40/447 |
| 3,965,593 | 6/1976 | Harruff | 40/447 |

*Primary Examiner*—Gene Mancene
*Assistant Examiner*—Wenceslao J. Contreras
*Attorney, Agent, or Firm*—B. P. Fishburne, Jr.

[57] ABSTRACT

A mechanically operated, gravity-assisted display device has the capability of being remotely controlled by an unskilled operator to display current numeric pricing indicia for a product or other alpha-numeric indicia for any required purpose. The device is ideally suited for displaying the unit price of gasoline on an elevated sign at a filling station. Multiple gravity-biased sliding panels which are arrayed to form variable indicia are operated remotely by flexible suspension elements equipped individually with fixed enlargements. Interchangeable coded remote operating cards for groups of the flexible suspension elements have passages through which predetermined enlargements may pass while other enlargements are blocked. Movement of the block enlargements with the flexible suspension elements to which they are attached under influence of the coded cards establishes the required change of displayed indicia. The coded cards are engaged in movable card holders which are shiftable between active and inactive positions in the housing of the controller.

15 Claims, 19 Drawing Figures

FIG.1
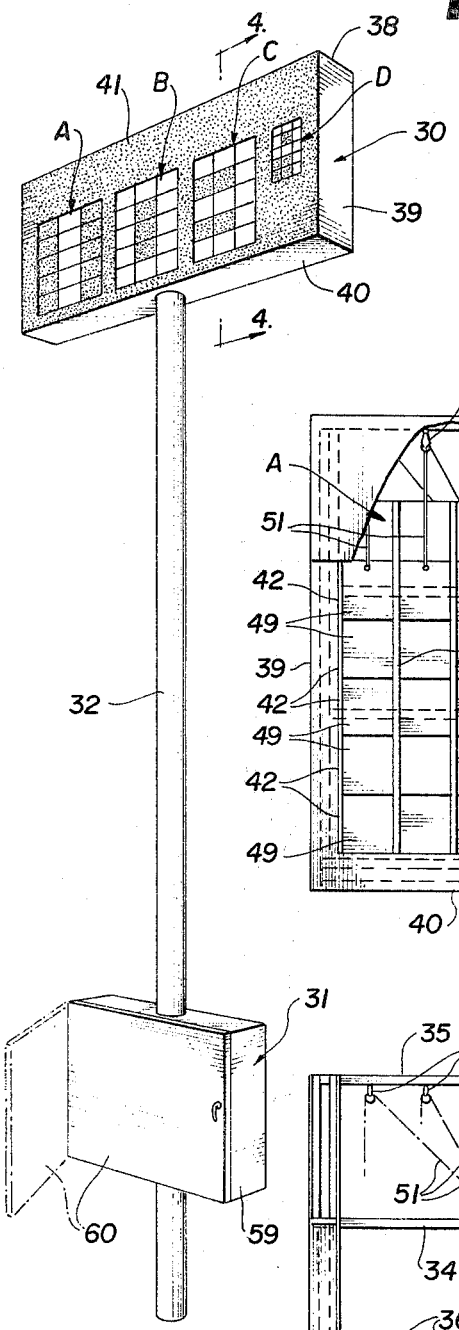
FIG.2
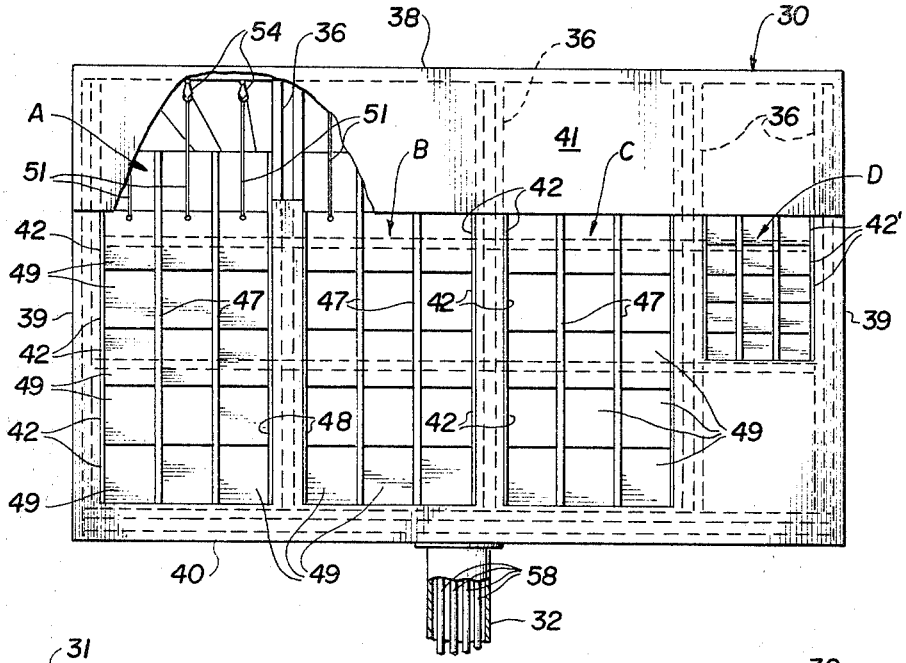
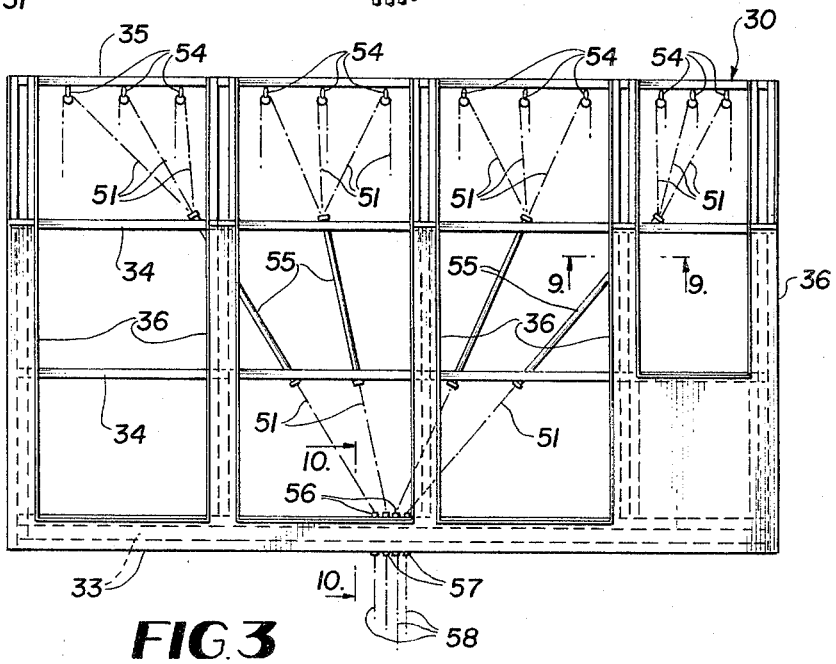
FIG.3

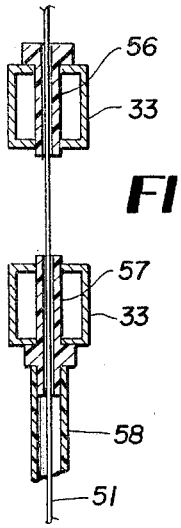
FIG.10
FIG.9
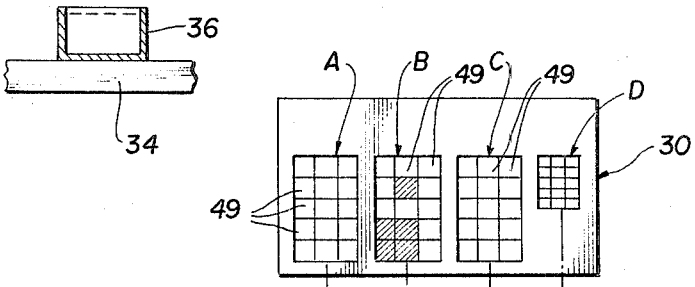
FIG.11
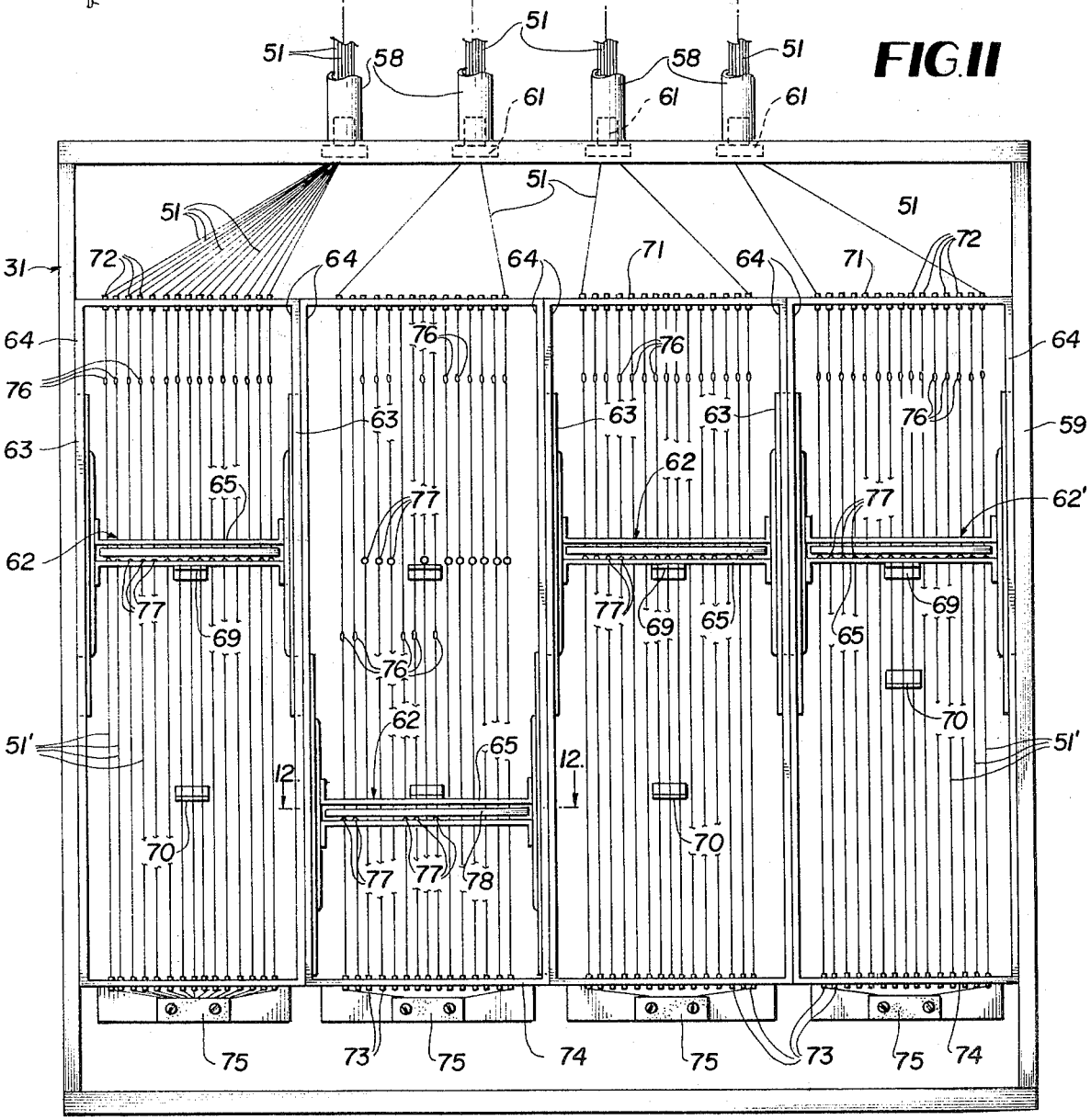

FIG.12
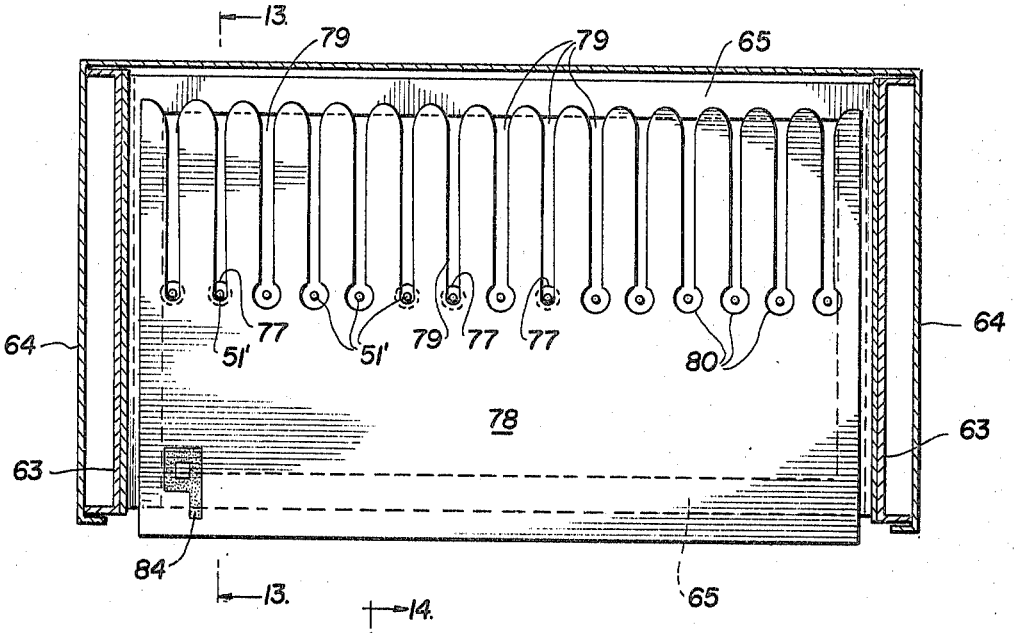
FIG.13
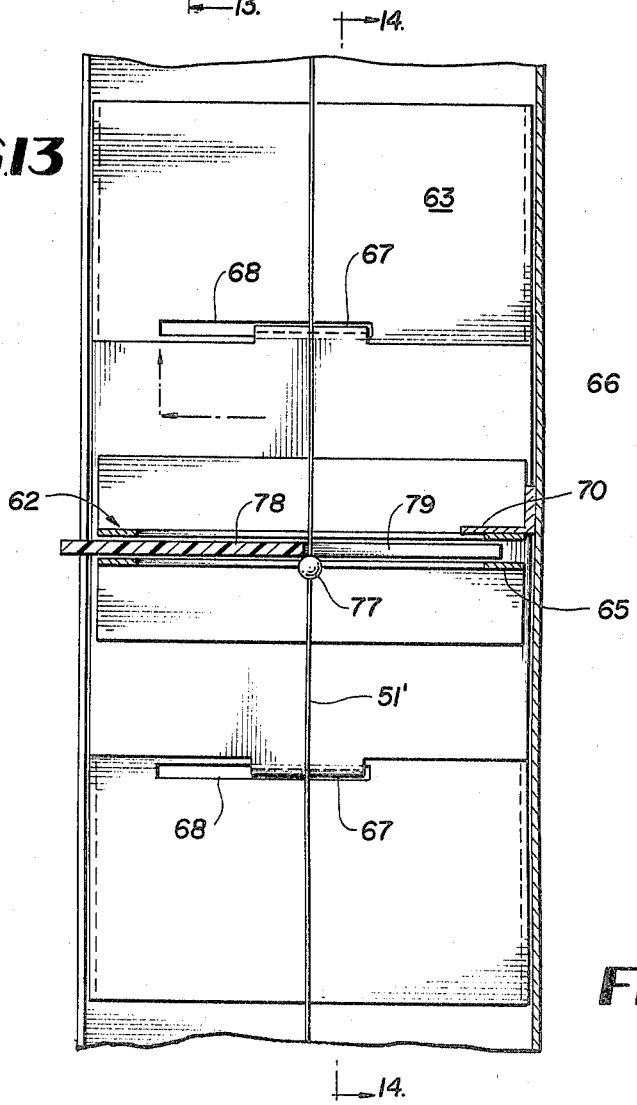
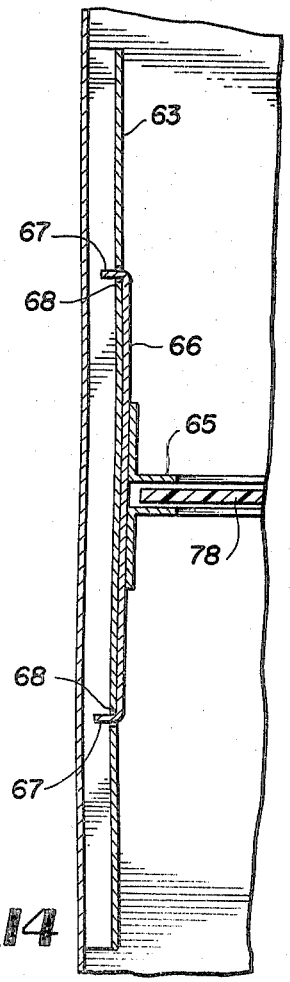
FIG.14

CHANGEABLE EXHIBITOR

BACKGROUND OF THE INVENTION

Many types of changeable display devices including signs for many purposes are known in the prior art. Some such devices are mechanical or electro-mechanical while others are entirely electronic in terms of operation. The prior art devices vary greatly in their cost and in their suitability for particular applications or uses. Clearly, a retail store owner cannot afford to install a sign or changeable exhibitor which costs many thousands of dollars. Other less expensive exhibitors, on the other hand, may lack the exhibiting capability which a given user requires.

With the above in mind, an objective of the present invention is to provide a changeable exhibitor which is suitable for a variety of applications in the displaying of prices for retail products, such as gasoline sold at filling stations to retail customers.

The exhibitor which is provided by the invention is versatile in its capability, is simplified and convenient to operate. It takes advantage of gravity in the assisting or biasing of its movable components and its operation is mechanical, without loss of capability attributed normally to electrical exhibitors which are impractical due to high cost for many applications.

The present exhibitor is ideally suited for remote mechanical control but may also be controlled in near proximity to its changeable displays. The gravity-biased manual control devices of the exhibitor may, in some cases, be powered in their movements by electrical or other power means.

In its simplest essence, the exhibitor forming the subject matter of the invention is embodied in a display unit which may be elevated or placed near ground level, in some cases. The display unit includes groups of exhibitor panels or plates which are adapted to move slidingly and in guided relationship in closely adjacent substantially vertical planes while being biased by gravity. Each display panel is connected to a flexible guided suspension element whose movement in one direction against gravity elevates that particular panel as a part of the formation of particular indicia requiring display.

Coded readily interchangeable cards engaged in movable card holders within a controller housing are displaced manually or by power means to move selected suspension elements while other elements of a particular group of display panels remain stationary under the biasing influence of gravity. The suspension elements which are thus moved cause shifting of the sliding display panels to produce required changes in displayed indicia whether numeric or otherwise. Each display panel suspension element carries a detached enlargement, such as a bead. Each coded card has slots which receive the suspension elements and certain of the slots have enlarged passages which enable the beads to pass through the coded card when the latter is displaced. Such beads are not moved by the card. Other card slots which do not possess enlarged passages engage the beads of preselected suspension elements to move such elements with their attached shiftable display panels to produce required displayed indicia changes on the display panel.

Other features and advantages of the invention will become apparent during the course of the following description.

BRIEF DESCRIPTION OF THE DRAWINGS

FIG. 1 is a perspective view of a changeable exhibitor such as a price display sign embodying the invention.

FIG. 2 is a front elevational view, partly broken away, of a display panel portion of the exhibitor.

FIG. 3 is a similar view of framing and associated parts in the display panel.

FIG. 9 is an enlarged fragmentary horizontal section taken on line 9—9 of FIG. 3.

FIG. 10 is an enlarged fragmentary vertical section taken on line 10—10 of FIG. 3.

FIG. 11 is a front elevation of a controller including a schematic representation of the associated display panel of the exhibitor.

FIG. 12 is an enlarged horizontal section taken on line 12—12 of FIG. 11.

FIG. 13 is a fragmentary vertical section taken on line 13—13 of FIG. 12.

FIG. 14 is a similar section taken on line 14—14 of FIG. 13.

DETAILED DESCRIPTION

Figure 4:
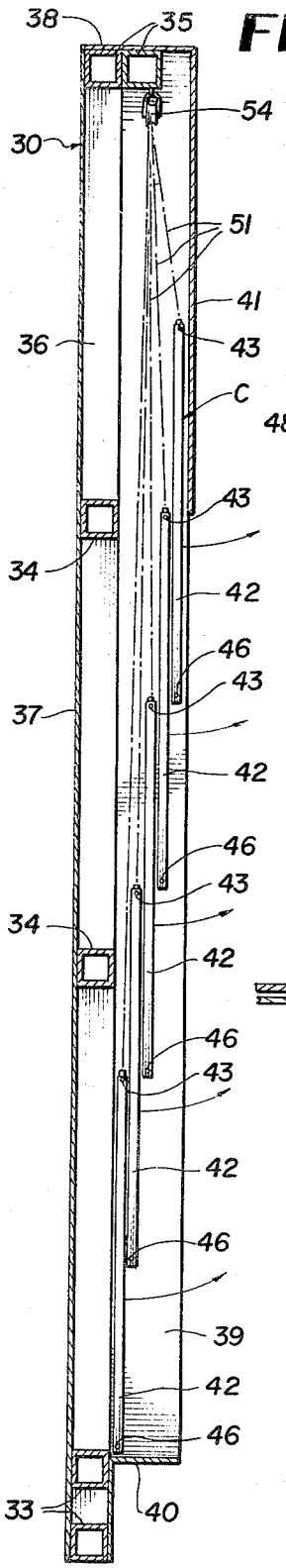
FIG. 4 is an enlarged vertical section taken on line 4—4 of FIG. 1.

Referring to the drawings in detail wherein like numerals designate like parts, there is shown in FIG. 1 an embodiment of the invention in the form of a sign of the type which can be employed at filling stations along any roadway. It should be understood that the invention is not limited to this particular configuration, and can be embodied in a wide variety of display devices.

The sign shown in FIG. 1 comprises an elevated display section 30 and a near ground level remote controller 31. Both of these sections or elements are mounted on a sturdy support pole 32 of any required height, such as a hollow pipe.

The elevated display portion of the sign comprises a strong rectangular frame shown best in FIGS. 3 and 4 including double horizontal frame bars 33 at the bottom thereof, spaced intermediate horizontal bars 34 and a top horizontal double perimeter bar 35. Spaced vertical frame bars 36 are also included in the rectangular frame between its top and bottom bars and are rigidly secured to the latter. The details of the support frame may be varied and are not critical to the heart of the invention.

The frame of upper sign display section 30 includes a rear weatherproof closure panel 37 joined with comparatively shallow top, side and bottom walls 38 and 39 and 40 to form a housing. As shown in FIG. 4, the front of the display section 30 has no housing wall and is open except for an upper comparatively short vertical panel or skirt 41 which depends from the forward corner of top wall 38 for a purpose soon to be described. The open front area of the upper section 30 constitutes the display face of the sign or exhibitor.

Figure 5:
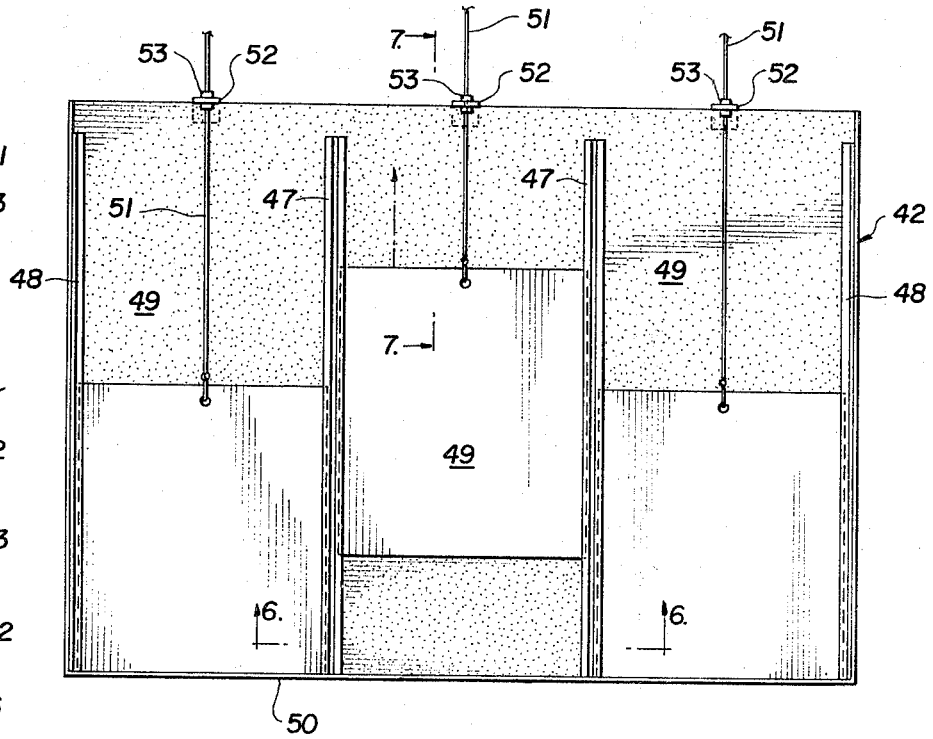
FIG. 5 is a front elevation of a single hinged holder or tray for plural display elements of the display panel.
Figure 8:
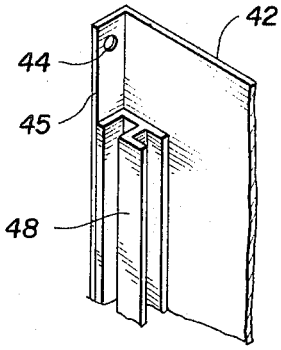
FIG. 8 is an enlarged perspective view of one corner portion of the tray in FIG. 5.

This display face shown in its entirety in FIGS. 1 and 2 comprises in the particular embodiment of the invention five normally vertical trays or holders 42, one of which is shown isolated in FIG. 5. Each such tray or holder 42 has its top pivotally held between adjacent parallel vertical frame bars 36 by horizontal axis pivot elements 43. Apertures 44, FIG. 8, to receive the supporting pivot elements 43 are formed in side flanges 45 of the trays 42 near their upper corners. The arrangement allows the several normally vertical trays 42 to have their lower ends swung outwardly from the vertical by pivoting around their upper ends, as shown by the arrows in FIG. 4. This greatly facilitates maintenance operations on the device in the field by allowing easy access to the interior of display section 30 without the necessity for completely disassembling and separating parts. Preferably, the lower ends of the pivoted trays 42 are secured in their normal vertical display positions by readily removable fasteners 46. This better enables the trays 42 to resist wind forces and the like without moving. As shown in FIG. 4, the rectangular trays 42 overlap each other in shingled relationship from top to bottom of the display face which they make up. Each tray overlaps and conceals behind it the upper half of the tray immediately therebelow. The fixed panel 41 similarly overlaps and conceals the upper half of the topmost tray 42. The several shingled trays are fixed in their relationship shown in FIG. 4 during the operation of the sign except for their ability to swing forwardly for maintenance, as described, when necessary.

The disclosed embodiment of the invention, FIG. 1, is adapted to display numeric pricing indicia for gasoline or the like, for example, $1.03 9/10 per gallon. It will be appreciated that this is only one capability of the invention. The size of the display face can be varied for different applications and different forms of indicia can be variably displayed. Greater or lesser numbers of the trays 42 making up the display face can be utilized.

As depicted in FIG. 2, there are three side-by-side vertical shingled rows or groups of the trays 42 designated A, B and C. Only the group C is shown in FIG. 4. These three rows or groups of trays are identical in construction and in mode of operation. A single half-size group D is provided following the full size group C for displaying fractional penny pricing in the particular embodiment being illustrated. The group D is identical in construction and operation to groups A, B and C except for the fact that its components are one-half size. In some applications of the invention, the half size indicia trays and components may not be required and will be omitted. A smaller or greater number of the full size groups or rows can be employed to meet any given indicia display need. In this respect, the invention is very versatile.

Figure 6:
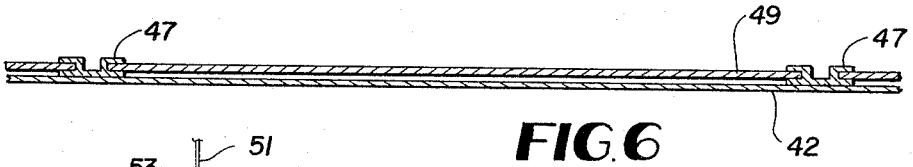
FIG. 6 is an enlarged fragmentary horizontal section taken on line 6—6 of FIG. 5.
Figure 7:
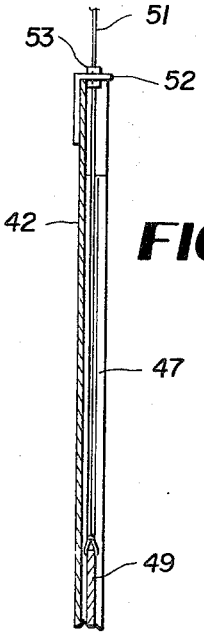
FIG. 7 is an enlarged fragmentary vertical section taken on line 7—7 of FIG. 5.

Within each shingled group of trays 42 and within the half size group D, where the trays are designated 42', FIG. 2, the following exists. Each tray is divided into three parallel vertical guideways by a pair of intermediate extruded dual channel tracks 47 shown in cross sectional detail in FIG. 6. Two parallel extruded single channel tracks 48, FIG. 8, form the outer boundaries of two guideways on opposite sides of a center guideway, the three vertical guideways being of equal widths and equal lengths in the vertical direction.

Within the three guideways of each tray 42 and slidably engaged in the channel tracks 47 and 48 for free guided movement vertically are three approximately square indicia display plates or panels 49 having their four corners rounded to prevent the possibility of binding in the guideways. The plates 49 have high visibility coatings at least on their forward faces. The forward face of each tray 42 is formed in a contrasting color, such as a dark dull color. The engaging surfaces of the tray with the plates 49 including the engaging surfaces of channel tracks 47 are PVC coated for dry lube effect in the sliding of the plates 49 to produce variable numeric displays in accordance with the disclosed embodiment of the invention.

As shown in FIG. 5, the vertical channel guideways for the plates 49 are substantially twice the lengths of the plates. When any plate 49 is moved upwardly to the top of its guideway in one of the shingled trays 42, it is concealed from view behind the lower half of the next uppermost tray 42, FIG. 4. The plates 49 are constantly biased downwardly by gravity and their downward movement is limited by contact with a horizontal stop flange 50 across the bottom of each tray 42.

Each separate plate 49 is independently suspended in its vertical guideway by a single preferably Dacron flexible suspension cord 51 secured to the top of each plate 49 at the center thereof for good balance. Upward travel of each plate 49 is limited by a stop bracket 52 fixed at the top of each tray guideway and equipped with a PVC grommet 53 for the smooth guidance of flexible suspension element 51.

It can now be stated that each vertical tray group or row A, B and C and the half size group D contains five of the shingled trays 42, each tray holding three of the movable indicia forming plates 49. Therefore, as viewed in FIG. 2, each tray group A, B, C and D includes fifteen of the independently movable plates 49 arranged in three parallel vertical rows below the concealing panel 41 when all plates 49 are lowered into contact with the stop flanges 50. When the entire display face of upper section 30 is viewed from a distance, the shingled or offset relationship of the trays 42 and their contained movable plates 49 is unnoticeable, and the displayed indicia appears to lie in one vertical plane, as shown in FIG. 1. Attached to the top frame member 35 of display section 30 above the center of each vertical column of plates 49 formed by the several trays 42 in the groups A, B, C and D are swiveled guide pulleys 54. Each pulley 54 is engaged by a bundle of five of the individual flexible cords 51 for each column of five of the plates 49 in the overlapping trays of a particular group A, B, C or D. In FIGS. 2 and 3, for simplicity of illustration, each bundle of five suspension cords 51 is schematically indicated as a single unit. In actuality, as explained, each pulley 54 receives and guides five cords 51 individual to the five plates 49 for each of the three plate columns of each group A, B, C and D.

After engaging the pulleys 54, the bundles of suspension cords 51 descend within the interior of upper section 30 behind the shingled trays 42, and as shown in FIG. 3 pass through downwardly converging PVC guide tubes 55 fixed between horizontal bars 34 of the framework. Three bundles of five cords 51 extend through each tube 55, so that each tube receives and guides fifteen of the cords 51 downwardly toward the bottom center of the upper display section 30. At such bottom center, the four bundles containing fifteen each of the suspension cords 51 enter and pass through additional PVC guides 56 and 57 fixed to the lower frame bars 33 and the bundles of fifteen cords then pass through further descending PVC guide tubes 58 inside of tubular pole 32 leading downwardly to controller 31.

It should be clearly understood that each plate 49 used in the formation of a particular display is independently suspended from a single cord 51 in its vertical guideway formed by channel tracks on one of the trays 42. By the operation of means in the controller 31, soon to be described, the required movements of individual plates 49 or groups of the plates are produced to create whatever numeric indicia is required on the display face of the upper unit 30. Such indicia could be alphabetic rather than numeric as particular application dictates, and the invention has display capabilities far beyond the particular numeric pricing indicia illustrated. Numerous types of signs and other display panels may embody the invention, as will be readily understood by those skilled in the art.

Continuing to refer to the drawings, the controller 31 comprises a rectangular box-like housing 59 having a hinged access door 60. The guide tubes 58 are connected into the top of controller housing 59 with PVC fittings 61 which further guide the four bundles of fifteen suspension cords 51 each into the controller. Within the controller 31 is a coded movable displacement assembly 62 for the display plate suspension cords 15 in each bundle or group of fifteen operating the plates 49 in one of the groups A, B, C or D. The displacement assemblies 62 are identical in construction and operation with the exception of the fact that the assembly 62' for the half size fraction display group D moves only half the distance moved by the other assemblies 62 for full size groups A, B and C.

Each suspension cord displacement assembly 62 comprises a card movement carriage comprising a pair of slides 63 which can travel upwardly or downwardly vertically between opposing parallel walls 64 fixed in the controller housing 59 in guided relationship. Each such card movement carriage further comprises a horizontally slotted card holder 65 attached to the carriages slides 63 through interlocking plates 66. Tongues 67 on the plates 66 engage movably within horizontal guide slots 68 of slides 63 whereby each slotted card holder to be grapsed and pulled forwardly horizontally by a distance determined by the lengths of guide slots 68.

In the vertical movement pathway for each carriage 62 and its slotted card holder 65, as defined by the parallel walls 64, is an upper fixed rest 69 for each card holder 65 upon which the card holder is supported when in an uppermost position, FIG. 11. A lower fixed rest or abutment 70 for each movable card holder is similarly provided in each card holder movement pathway of the controller 31. One of the lower abutments 70 is shown in FIG. 13. When the associated card holder 65 is in a downmost operative position, it engages under and is held down by the lower abutment 70 against gravity acting on the associated display plates 49 which transmit forces to the card holder through the suspension cords 51, tending to pull the card holder 65 upwardly.

To operate each card holder 65 along its vertical movement path with the remainder of the carriage assembly 62, the card holder is grasped and pulled horizontally along the guide slots 68 toward the open front of the controller housing 59. This horizontal movement is sufficient to disengage the card holder from either of the elements 69 and 70 so that the card holder can be shifted upwardly or downwardly within its vertical movement passages, it being borne in mind that gravity acting on the plates 49 tends to bias all of the card holders upwardly in the controller 31. When the plates 49 are down resting on the bottom stop flanges 50 of trays 42, the suspension cards 51 will be substantially taut between their attachment points with the tops of plates 49 and their far ends. However, since the plates 49 are being supported by flanges 50, the card holders 65 will no longer tend to move upwardly and will remain normally at rest on upper support elements 69. These elements and the elements 70 are fixed as by welding to the back vertical wall of controller housing 59.

A horizontal web 71 at the tops of card holder movement pathways contains parallel vertical axis PVC guides 72 for each of the sixty individual suspension cords 51 to maintain them in separated spaced parallel relationship. Similar PVC guides 73 for the cords 51 are mounted on a horizontal web 74 across the bottoms of the card holder movement pathways. The bottom terminals of the suspension cords are held securely below the guides 73 in sandwich-type clamps 75 within the controller.

Preferably, to simplify installation and servicing of the exhibitor, the individual suspension cords 51 extending from the plates 49 downwardly into controller 31 are spliced as at 76 near the tops of the card holder movement pathways with extensions 51' of the suspension cords which can more conveniently be prestrung in the controller 31 in the shop or factory. Later, when the actual sign or exhibitor is installed on a job site, the installers can form the splices 76 utilizing small fishing line swivels or leaders or any equivalent connector.

At lower elevations, the cord extensions 51' have beads 77 fixed thereon in horizontal side-by-side relationship adjacent to the bottom of each card holder 65 when the latter is in its full up rest position. These beads form elements of a coded transport system for individual suspension cords 51 and their connected display forming plates 49 to form varying indicia on the display base of upper section 30. Coacting coded cards 78 of comb-like formation have slots 79 at their leading ends which straddle or receive the individual cords 51' when the card is slipped horizontally into the slotted holder 65. When so placed while the holders 65 are above the rests 69, the beads 77 lie immediately below the coded cards, FIG. 13. Predetermined slots 79 of the cards have enlarged openings 80 at their rear ends while other slots forming the coding system lack these openings and are of uniform width from end-to-end. Three such uniform slots are shown in FIG. 12 for illustration in connection with the cards 78 in FIG. 11 for the display group B, second from the left on the sign display face. It will be readily understood that a multiplicity of cards 78 for the holders 65 are provided to produce all necessary individual and group movements of the plates 49 necessary to produce any required indicia display.

Simply stated, when a particular card 78 for any group of plates 49, A through D, is placed in the movable holder 65 for the correct group, subsequent movement of the card holder from the up position to the down position in the controller will produce movement only of the suspension cords 51 which lead to particular plates 49 which must be raised in their trays 42 to create the desired numeric or other indicia on the display face of unit 30.

As the card holder 65 and its card 79 descend in the controller, the cords 51' and their beads 77 will pass freely through the card openings 80 and those particular suspension cords and their connected plates 49 are not moved. However, those slots 79 without the enlarged openings 80 will bear down on the beads 77 below them and produce downward movement of the cords 51' connected with those particular beads. This, in turn, will elevate the plates 49 of those particular cords to their upper portions in the trays 42, such movement of the plates being limited by the upper stops 52. When the coded card 78 for a particular display plate group A through D is locked down beneath one of the elements 70, the associated plates 49 will remain elevated at the tops of the trays 42 and the force of gravity on the plates tending to move the card holders 65 upwardly is resisted by elements 70. The particular plates 49 of groups A through D which are elevated and held in this manner are concealed from view behind either the panel 41, in the case of the uppermost tray 42, and behind the lower half of the next forwardmost tray 42 in all other cases. In this manner, the other remaining high visibility plates 49 of the groups A through D which remain unelevated will form the desired variable indicia display on the display face of unit 30. By supplying sufficient coded cards 78, the structure is capable of producing any required indicia display, as should now be clear to those skilled in the art.

While the carriages 62 including their card holders 65 may be moved manually between the upper and lower positions defined by the elements 69 and 70, it will be appreciated that mechanical or electrical power means could be installed to drive the carriage assemblies along their vertical pathways.

In FIG. 11 it will be noted that the lower stop or abutment 70' for half size group D is spaced only half the distance from upper rest 69 compared to the elements 70 for the full size groups or displays. As stated previously, in some cases, the half size display may not be required, in which case the controller 31 could have all identical card movement distances and any required number of card holders can be included in the controller to produce less complex or more complex displays.

Figure 15:
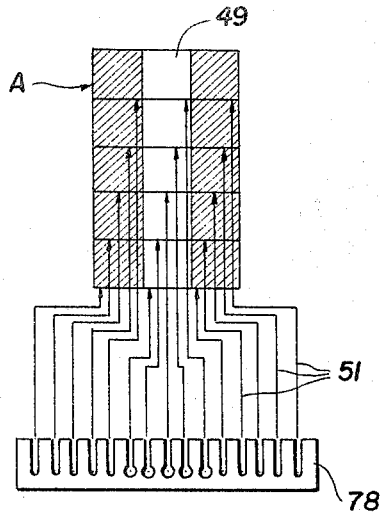
FIGS. 15, 16 and 17 are schematic views depicting the control and movement of sliding display elements in groups by means of coded cards to cause indicia changes on the display panel.
Figure 16:
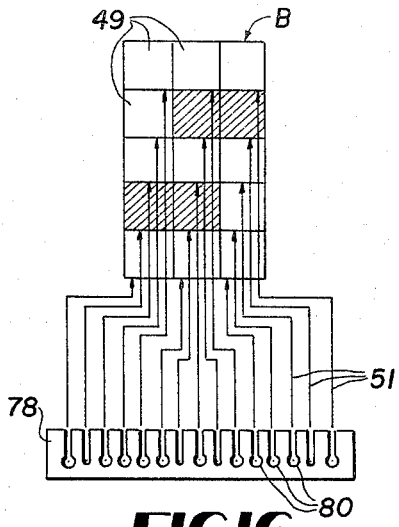
Figure 17:
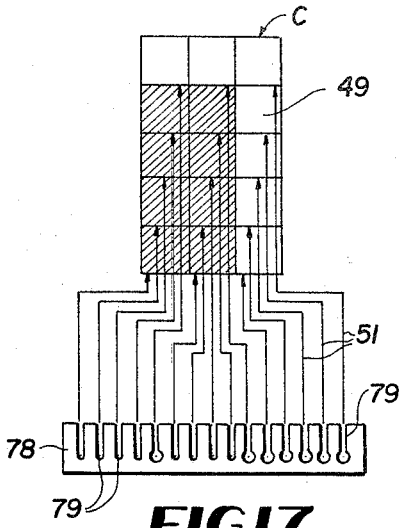

FIGS. 15, 16 and 17 are included to show schematically all of the fifteen plates 49 in the main groups A, B and C used to form any required indicia. These schematic views also show the relationship of all of the individual suspension cords 51 to the coded cards 78 and the individual associated gravity-biased plates 49. Some of the other mechanical views, as described, depict integral bundles or groups of the suspension cords 51 and FIGS. 15–17 clarify the arrangement.

Figure 18:
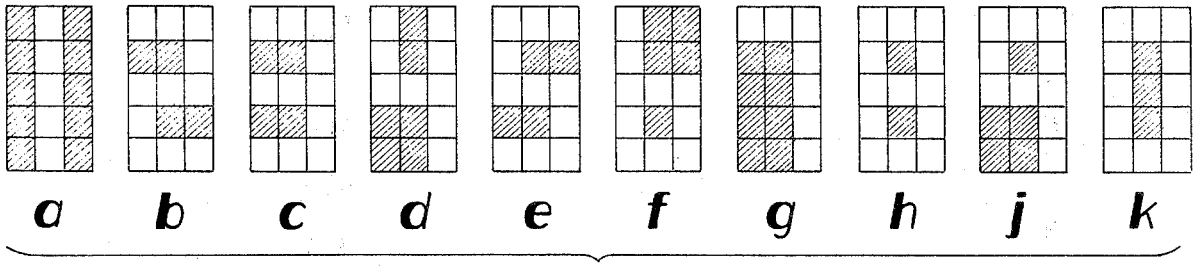
FIG. 18 is a view showing numeric indicia 1 through 9 and 0 obtainable by use of the exhibitor.

FIG. 18 shows a full numeric display from 1 to 9 and 0 which the display face of the sign is capable of creating in the boundaries of the main groups A, B and C each having fifteen of the plates 49 in three vertical columns, as described. The numeric indicia in FIG. 18 is referenced by the letters a through k. The display in FIG. 15 is the display at a in FIG. 18. The display in FIG. 16 is the display e in FIG. 18 and the display in FIG. 17 is shown at g in FIG. 18.

Figure 19:
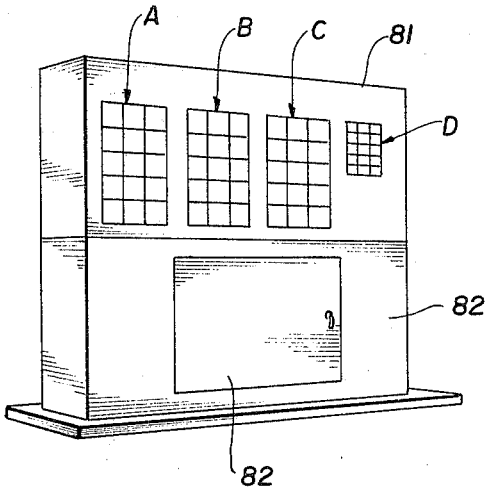
FIG. 19 is a perspective view of an exhibitor according to another embodiment where the display panel is located proximally to the controller.

FIG. 19 illustrates that the invention can be embodied entirely in a ground level unit having a display face 81 including the described groups A, B, C and D. The controller described in FIG. 11 can be placed immediately below the display face in a housing 82 having an access door 83. Thus, the invention lends itself to either remote or proximal control.

To even further simplify the installation and the stringing of the device, the cords 51 could be color-coded or the top wall 71 can have consecutive numbers thereon adjacent to the cord guides 72 corresponding to like numbers on the individual movable plates 49. For example, the latter can be numbered in their vertical rows beginning at the bottom of the first row in each group A, B, etc. 1 through 5, 6 through 10, and 11 through 15.

Similarly, each coded card 78 should contain an indicia character 84, FIG. 12, to identify it. This character, such as a numeral, will indicate the character or numeral produced on the display face of unit 30 in response to the use of a particular card 78.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A changeable indicia display device comprising a support, plural substantially vertical indicia plate trays on the support and having their upper ends pivotally attached to the support, the trays being arranged in shingled relationship so that substantially the lower half of each tray covers and conceals the upper half of the tray immediately below it when the trays are vertically disposed, substantially vertical parallel indicia plate guideways on the trays, indicia plates movably engaged in the guideways and being gravity biased downwardly therein, there being one indicia plate in each guideway of each tray of a size whereby each indicia plate has a vertical length equaling approximately one-half the length of its guideway, positive stop means on each tray near its upper and lower ends to limit upward and downward movement of the indicia plates, a flexible suspension element connected to each indicia plate of each tray to raise the indicia plate in its guideway, the indicia plates of the shingled trays lying in parallel vertical columns and the trays being disposed on the support in plural side-by-side groups, guide means for the suspension elements of the indicia plates in each column on the support near the top of each column, and additional guide means on the support below the first-named guide means for the suspension elements of the first-named guide means of the columns of indicia plates of each group of trays, whereby selected indicia plates of selected columns in the tray groups can be elevated to form indicia characters on the trays of said groups.

2. A changeable indicia display device as defined in claim 1, and a panel on said support near its top overlapping and concealing substantially the upper half of each uppermost tray in said groups.

3. A changeable indicia display device as defined in claim 1, and the positive stops on the trays near their upper ends additionally comprising guides for the indicia plates of each tray.

4. A changeable indicia display device as defined in claim 1, and each flexible suspension element comprising a cord connected to the top of each indicia plate at its center.

5. A changeable indicia display device as defined in claim 1, and said guideways of each tray being defined by spaced parallel opposing fixed channel members on each tray, the channel members receiving vertical edge portions of the indicia plates slidingly.

6. A changeable indicia display device as defined in claim 1, and the additional guide means comprising downwardly converging tube members on the support directing all of the suspension elements from the first-named guide means toward the center of the support at its bottom.

7. A changeable indicia display device comprising a support including an indicia display face, said display face including plural discrete indicia character display areas, substantially vertical shingled indicia plate carriers for each display area each having plural independently vertically movable indicia plates guidedly mounted thereon for vertical movement, the indicia plates of the carriers in said areas defining vertical columns of indicia plates in said areas, guided flexible suspension elements for each indicia plate of each column in each area, whereby selected indicia plates can be elevated to concealed positions to thereby form required characters in said display areas, and coacting coded mechanical means operatively engaged with said suspension elements of said plates to elevate selected plates and maintain them in elevated positions against the force of gravity.

8. A changeable indicia display device as defined in claim 7, and the mechanical means comprising means engaging the individual suspension elements and holding them movably in spaced parallel guided relationship, said suspension elements each having a fixed enlargement thereon at one elevation, a movable coded card holder and vertical guideway means for such holder adjacent to the suspension elements for each display area, and at least one coded card insertable in each movable card holder above said fixed enlargements and having coded through passages for predetermined enlargements and blocking means for the remaining enlargements of each group of suspension elements corresponding to said display areas, and means to lock each card holder independently in a lowered position sufficiently to fully elevate the display plates of suspension elements whose enlargements are blocked by the coded card when the latter is moved downwardly with said holder.

9. A changeable indicia display device as defined in claim 8, and said support comprising a pole for positioning said display face at an elevated position relative to ground level, and said coacting coded mechanical means being near ground level to control the elevation and the lowering of said display plates remotely.

10. A changeable indicia display device as defined in claim 8, and means to anchor the terminal ends of the suspension elements corresponding to each display area remote from the display plates with which they are connected at the bottom of said mechanical means.

11. A changeable indicia display device as defined in claim 10, and the anchoring means comprising clamps for the terminal ends of the suspension elements.

12. A changeable indicia display device as defined in claim 8, and said fixed enlargements comprising beads fixed on the suspension elements, and each coded card comprising a substantially rigid comb-like plate having spaced teeth defining slots to receive the suspension elements, and the coded through passages comprising enlarged through openings at the interior ends of said slots.

13. A changeable indicia display device as defined in claim 8, and a fixed rest for each movable card holder in its full up position whereby the associated display plates are then in their full down positions on the plate carriers and their associated suspension elements are substantially taut.

14. A changeable indicia display device as defined in claim 13, and fixed parallel guideway means for the movable card holders to guide each card holder on a linear path, and restrained lateral movement guidance means for said card holders in the guideway means enabling their ready engagement and disengagement with said fixed rest and said means to lock each card holder in its lowered position.

15. A changeable indicia display device as defined in claim 9, and said pole being hollow and having guidance means for groups of the flexible suspension elements.

* * * * *